US011163245B2

(12) United States Patent
Fitzgerald et al.

(10) Patent No.: US 11,163,245 B2
(45) Date of Patent: Nov. 2, 2021

(54) EMBEDDED MEMORY RESOURCES

(71) Applicant: Hewlett-Packard Development Company, L.P., Spring, TX (US)

(72) Inventors: Sean Daniel Fitzgerald, Boise, ID (US); Jeffrey H. Luke, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/968,359

(22) PCT Filed: Apr. 30, 2018

(86) PCT No.: PCT/US2018/030252
§ 371 (c)(1),
(2) Date: Aug. 7, 2020

(87) PCT Pub. No.: WO2019/212498
PCT Pub. Date: Nov. 7, 2019

(65) Prior Publication Data

US 2020/0393779 A1 Dec. 17, 2020

(51) Int. Cl.
*G03G 15/08* (2006.01)
*B41J 2/175* (2006.01)

(52) U.S. Cl.
CPC ..... *G03G 15/0865* (2013.01); *B41J 2/17556* (2013.01)

(58) Field of Classification Search
CPC ..... G03G 15/0863; G03G 15/0865; G03G 15/0879; G03G 15/5066; G03G 21/1652; G03G 21/1875; G03G 21/1823; G03G 2215/0697; G03G 2221/166; G03G 2221/1823; B41J 2/17559
USPC ..... 399/107, 109–111, 262
See application file for complete search history.

(56) References Cited

U.S. PATENT DOCUMENTS

| | | | | |
|---|---|---|---|---|
| 6,010,210 | A | 1/2000 | Wilson et al. | |
| 7,573,501 | B2 | 8/2009 | Silverbrook | |
| 7,720,416 | B2 * | 5/2010 | Taguchi | G03G 15/0868 399/258 |
| 8,159,349 | B2 | 4/2012 | Clarke et al. | |
| 8,311,419 | B2 | 11/2012 | Jones et al. | |
| 8,621,212 | B2 | 12/2013 | Lim et al. | |

(Continued)

FOREIGN PATENT DOCUMENTS

| | | | |
|---|---|---|---|
| EP | 1201441 | A1 | 2/2002 |
| EP | 1992491 | A2 | 11/2008 |

(Continued)

*Primary Examiner* — Hoan H Tran
(74) *Attorney, Agent, or Firm* — Staas & Halsey, LLP

(57) ABSTRACT

In an example, a container includes a housing with a memory resource embedded therein, an electrical contact coupled to an exterior of the container, and an electrical lead coupled to the memory resource and the electrical contact. In another example, a toner cartridge includes a controller embedded within a material of a housing and an electrical contact on an exterior surface of the housing and electrically coupled to the controller. In an example method of manufacturing a container, a memory resource is placed in a mold, material is injected into the mold such that the memory resource is embedded in the material, and the material is allowed to solidify.

15 Claims, 5 Drawing Sheets

(56) References Cited

U.S. PATENT DOCUMENTS

| | | | | |
|---|---|---|---|---|
| 9,421,783 | B2 * | 8/2016 | Quinn | B41J 2/17526 |
| 9,660,802 | B1 | 5/2017 | Mckinley | |
| 2005/0162455 | A1 | 7/2005 | Silverbrook | |
| 2006/0103701 | A1 | 5/2006 | Chan | |
| 2015/0139688 | A1 | 5/2015 | Leemhuis et al. | |

FOREIGN PATENT DOCUMENTS

| | | | |
|---|---|---|---|
| EP | 1847395 | | 6/2010 |
| EP | 2535192 | A2 | 12/2012 |
| JP | 2001212976 | A | 8/2001 |

* cited by examiner

EMBEDDED MEMORY RESOURCES

BACKGROUND

Images are processed for use with computing machines, such as a print apparatus. A print apparatus, for example, may use control data based on processed image data to produce a physical representation of an image by operating a print material placement system according to the control data. The print apparatus may include a print material receiving station to receive a container of print material to use in producing the physical representation.

DETAILED DESCRIPTION

Figure 1:
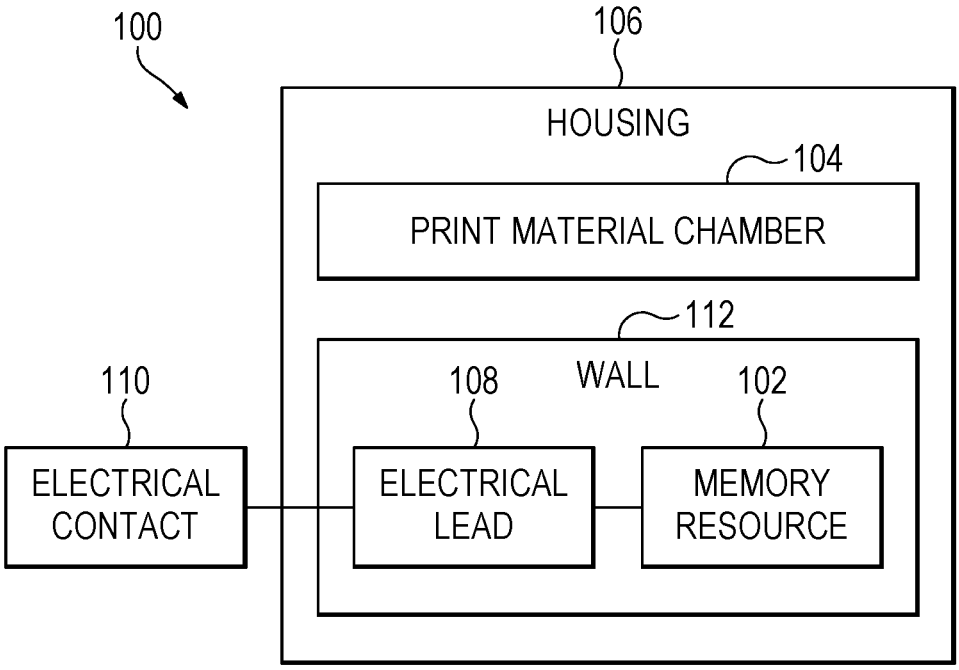
FIG. 1 is a block diagram depicting an example print material container.

In the following description and figures, some example implementations of print apparatus, print material cartridges, print material containers, and/or methods of manufacturing a container are described. In examples described herein, a "print apparatus" may be a device to print content on a physical medium (e.g., paper, textiles, a layer of powder-based build material, etc.) with a print material (e.g., ink or toner). In some examples, the physical medium printed on may be a web roll or a pre-cut sheet. In the case of printing on a layer of powder-based build material, the print apparatus may utilize the deposition of print materials in a layer-wise additive manufacturing process. A print apparatus may utilize suitable print consumables, such as ink, toner, fluids, powders, or other raw materials for printing. In some examples, a print apparatus may be a three-dimensional (3D) print apparatus. An example of print material is powder toner heatable by a heat transfer device, such as carbon-based toner, plastic-based toner, or a plant-derived toner heatable by a laser or fuser. Another example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

In some example print apparatus, an exchangeable and/or rechargeable print material container may be used. The print material container may be attachable and detachable to a print material cartridge coupleable to a print apparatus. For example, a toner vessel may be charged and connected to a toner cartridge that is insertable into a toner receiving station of a laser print apparatus. The print material container may be sealingly connectable to the print apparatus (via the print material cartridge) to provide print material from the print material container to the print apparatus to use in a printing operation. The print material cartridge and/or the print apparatus may utilize information about the print material vessel and/or print material cartridge in an operation of the print apparatus. For example, a print cartridge may feature an electronic chip (e.g., a memory resource) attached, after assembly, to a print cartridge that is capable of reporting data and/or record data.

Various examples described below relate to embedding a memory resource in a print material container. By embedding a memory resource with information about the print material container, the memory resource is protected by the container housing, for example. In this manner, the memory resource and the data stored thereon may maintain a level of integrity suitable for use with a print cartridge and/or print apparatus. As an example, a secure smart-chip embedded in a container may provide data to a print apparatus to inform the device of attributes or features of the colorant or other particulates related to the colorant of the container to the device or cartridge. Example attributes or features may include chamber volume, mass of print material, print material remaining, print material type, print material characteristics, chemical composition, metallurgy, stir-rate integrity, and the like. The memory resource location for molding-in may be in an intricate or hard-to-reach location (e.g., unreachable without specialized equipment or significant container manipulation) during manufacturing that make integration with a colorant container (e.g., colorant container) without specialized equipment difficult. The memory resource may be located on a non-visible location within the molding of the print cartridge or colorant container with electrical leads molded into the containers to limit the likelihood of a counterfeit chip being added after the manufacturing process, and a remote connection, via the electrical leads, to the print device or cartridge may be established when physical contact and electrical conduction is made. By providing an electrical connection to the memory resource embedded in the print material container, information provided in the memory resource may be retrievable by a compute system to perform an operation of the print apparatus based on the information on the memory resource, for example.

FIG. 1 is a block diagram depicting an example print material container 100. The print material container 100 of claim 1 generally includes a housing 106 with a print material chamber 104, a memory resource 102 embedded in a wall 112 of the housing 106, and an electrical contact 110 electrically coupled to the memory resource 102 via an electrical lead 108. Data residing on the memory resource 102 may be retrievable via circuitry electrically coupled to the electrical contact 110.

The housing 106 may be made of any appropriate material formable into a container. For example, a polymer composite may be used to form the housing 106 to define a print material chamber 104 and a wall 112, in which the memory resource 102 is embeddable. Example plastic polymers may include thermoplastic polymers such as acrylonitrile butadiene styrene (ABS), synthetic resins such as vinyl, semi-synthetic organic compounds, organic polymers, and the like. Other appropriate structural materials useable to form the housing 112 include metal, plastic, ceramic, glass, rubber, and the like, or any composite thereof. The wall 112 (as well as any other portion of the housing as discussed herein) may be made of the same structural material as the remainder of the housing 106 or may be made of different structural material.

The wall 112 of the housing 106 may be any structure of the housing 106. As examples, the wall 112 may be a sidewall of the housing, a periphery of an enclosure of the housing, a physical divider of interior space within the housing, a protrusion extending from the housing, a protrusion extending into the housing, a portion of a unibody structure of the housing, and the like.

The memory resource 102 is to be embedded in the structure of the housing 106. The memory resource 102 may be considered to be embedded in a wall 112 of the housing 106 when the memory resource 102 is fully enclosed by the material of the wall 112 or partially enclosed by the material of the wall 112. For example, the memory resource 102 may be securely fixed inside a surrounding mass of the same polymer used to build the wall 112. For another example, the wall 112 may be a unibody piece of the housing 106 that defines a slot to insert the memory resource 102 where the memory resource 102 is embedded once it is inserted into the slot. In this manner, the memory resource 102 may be embedded by enclosure in a continuous structure rather placed in a structure composed of multiple parts. As used herein, a memory resource is not embedded in the housing when the memory resource is placed between two physically divided structures, even if the divided structures are joined together such as by complementary and/or interlocking faces. Such an example may be two physically separate, interlocking parts that create a cavity of the size of the memory resource when the two interlocking parts are placed together (e.g., create a cavity between surfaces of the interlocking parts where other surfaces of the interlocking parts abut together upon mating the surfaces). Indeed, an embedded memory resource 102 may utilize an electrical lead extending from the location of the memory resource 102 because the memory resource 102 may not be otherwise electrically accessible when enclosed by the material of the housing.

The wall 112 of the housing 106 that contains the memory resource 102 may also contain an electrical lead 108. The electrical lead 108 may be formed of any appropriate electrically conductive material to couple the memory resource 102 to the electrical contact 110. The electrical lead 108 may be embedded in the wall 112 of the housing where the length of the electrical lead 108 corresponding to the wall 112 is fully enclosed by material of the wall 112 or located within a channel defined through the wall 112 in which the electrical lead 108 fits. The electrical contact 110 is coupled to the housing 106 and located on the exterior of the housing 106 to allow for an electrical contact point with access to the memory resource 102. The electrical contact 110 is also formed of any appropriate electrically conductive material. The electrical contact 110 may also be partially embedded in the housing 106 with a surface exposed on the exterior facing surface to allow for external electrical connection.

Figure 2:
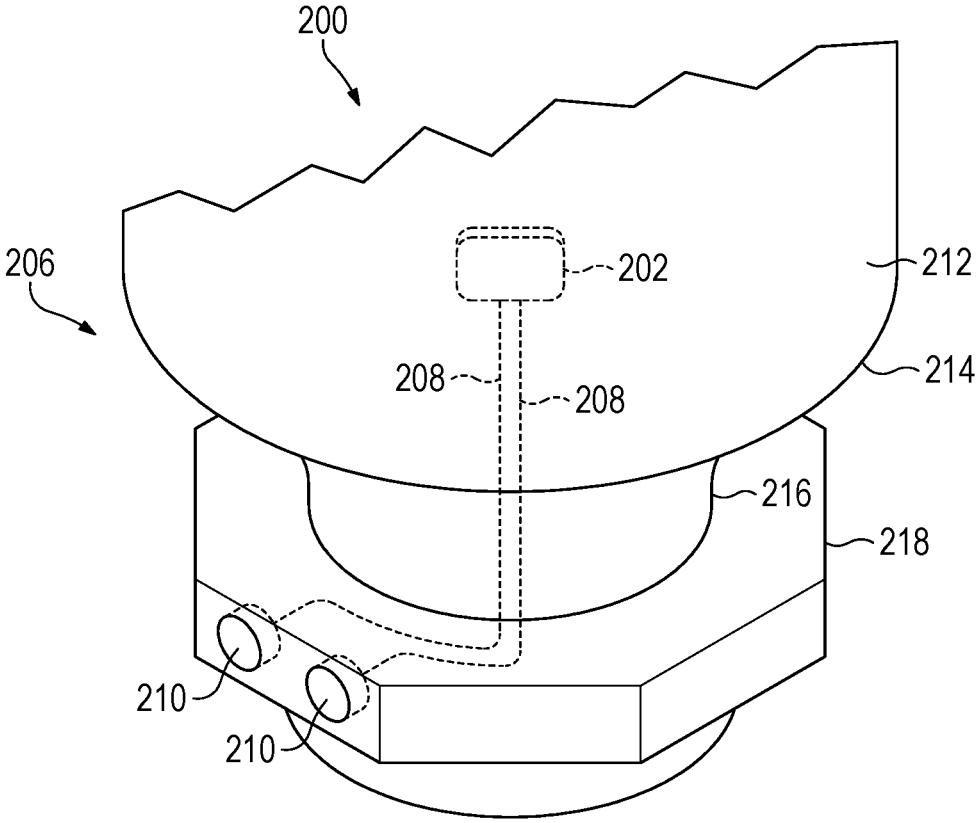
FIGS. 2-4 are isometric views of an example print material containers.
Figure 3:
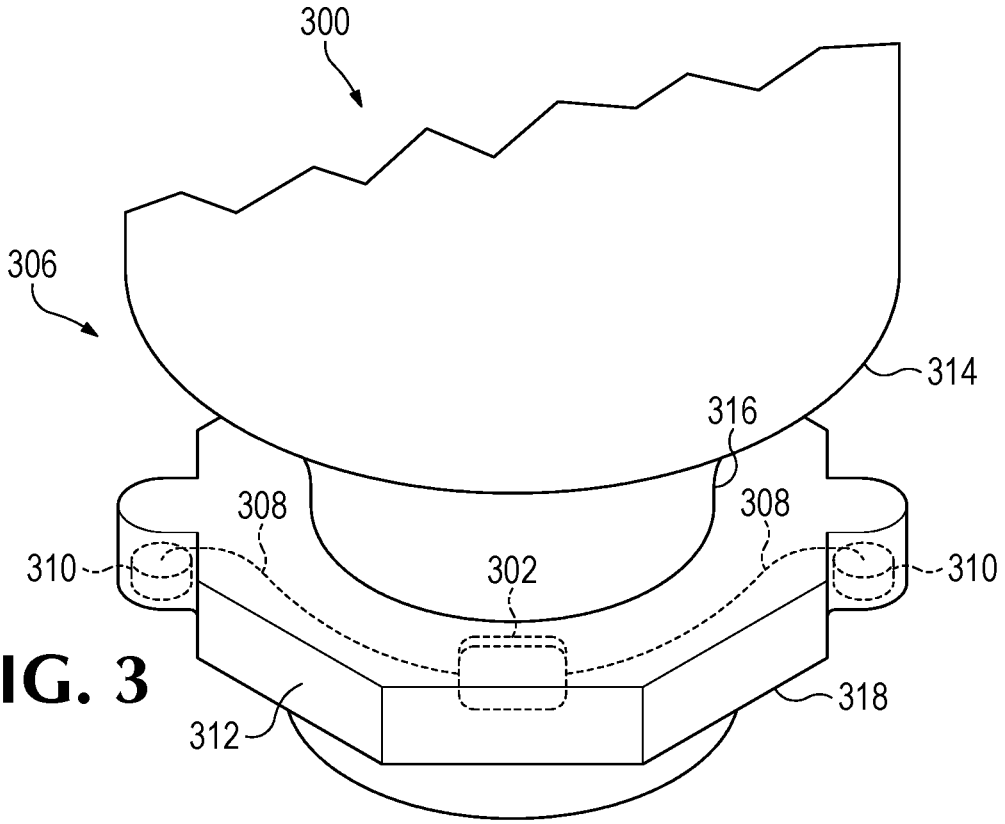
Figure 4:
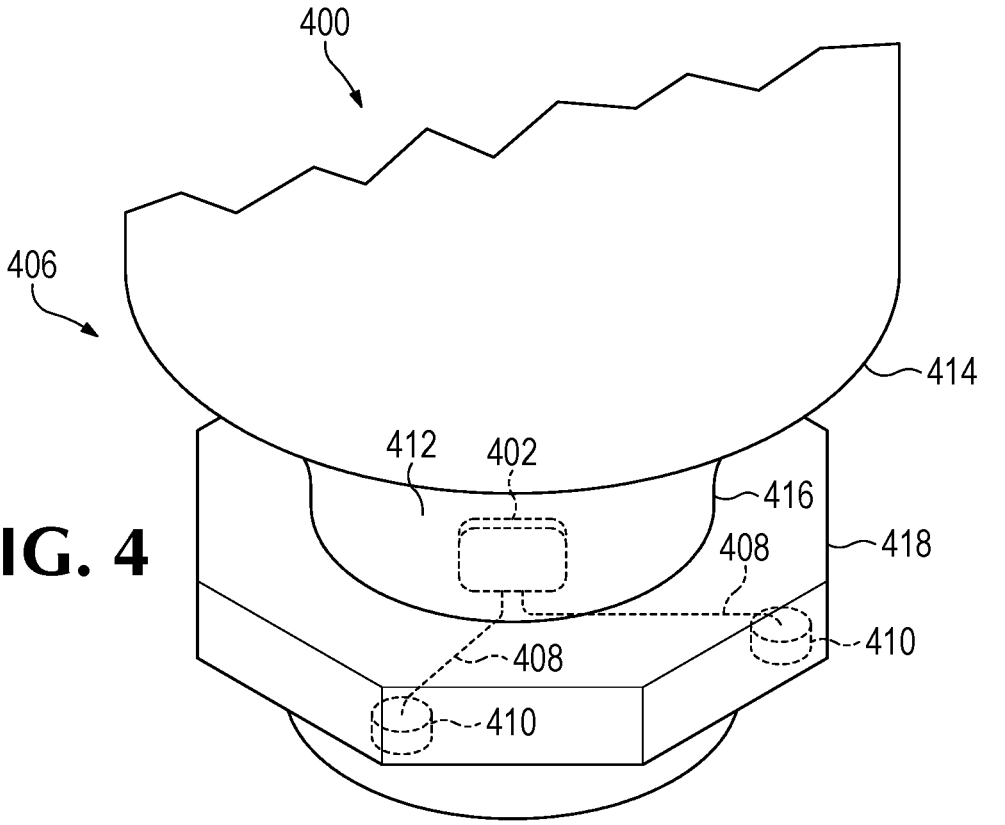

FIGS. 2-4 are isometric views of an example print material containers 200, 300, and 400. Referring to FIG. 2, the print material container 200 generally includes a housing 206 defining a body 214, a neck, 216, and a rim 218. In the examples of FIG. 2, a print material chamber may be located within the body 214. The body 214 of FIG. 2 is depicted as tubular. In such an example, a cross-section of the tubular body may be any geometric shape. Other examples of body shapes include spherical, cuboid, a cube with rounded corners, a pyramid with rounded corners, and the like. In a similar fashion, neck shapes and rim shapes may be tubular with any number of geometric cross-sections (e.g., circle, square, triangle, rectangle with rounded corners, hexagon, etc.). The rim 218 defines a port coupled to the print material chamber located in the body 214. The neck 216 is coupled to the body 214 and the rim 218 is coupled to the neck 216. The body 214, neck 216, and rim 218 may include a channel, series of channels, or other interface to guide print material from the print material chamber to the port defined by the rim 218.

The memory resource may be embedded in a wall of the body, a wall of the neck, or a wall of the rim. The electrical contacts may be located on an exterior surface of the rim, neck, body, or other portion of the housing. Example implementations are shown in FIGS. 2-4.

Referring to FIG. 2, the memory resource 202 is embedded in a wall 212 of the body 214 of the housing 206 of the container 200. Electrical contacts 210 are located on an exterior surface of the rim 218 facing away from the rim 218 on a side of the neck 216 and coupled to the memory resource 202 via electrical leads 208. The rim 218 may define a port coupled to a channel in the neck 216 coupled to a print material chamber in the body 214. In this manner, the memory resource 202 may be embedded in a wall of the body 214 defining a chamber.

Referring to FIG. 3, the memory resource 302 is embedded in a wall 312 of the rim 318 of the housing 306 of the container 300. Electrical contacts 310 are symmetrically located on an exterior surface of the rim 318 facing away from the body 314 on opposing sides of the neck 316 and coupled to the memory resource 302 via electrical leads 308. The rim 318 may define a port coupled to a channel in the neck 316 coupled to a print material chamber in the body 314. In this manner, the memory resource 302 may be embedded in a wall of the rim 318 defining a port.

Referring to FIG. 4, the memory resource 402 is embedded in a wall 412 of the neck 416 of the housing 406 of the container 400. Electrical contacts 410 are asymmetrically located on adjacent sides of an exterior surface of the rim 418 facing away from the body 414 and coupled to the memory resource 402 via electrical leads 408. The rim 418 may define a port coupled to a channel in the neck 416 coupled to a print material chamber in the body 414. In this manner, the memory resource 402 may be embedded in a wall of the neck 416 defining a channel between the print material chamber and the output port of the container.

The memory resources discussed herein may be a passively accessible storage medium or may be part of an active system capable of retrieving and sending data of the storage medium. For example, a cartridge shell (into which fits the container) may include a processor resource electrically coupled to an electrical contact of the cartridge shell in electrical communication with an electrical contact of the container such that the processor resource of the cartridge shell is able to retrieve data from the memory resource of the container.

Figure 5:
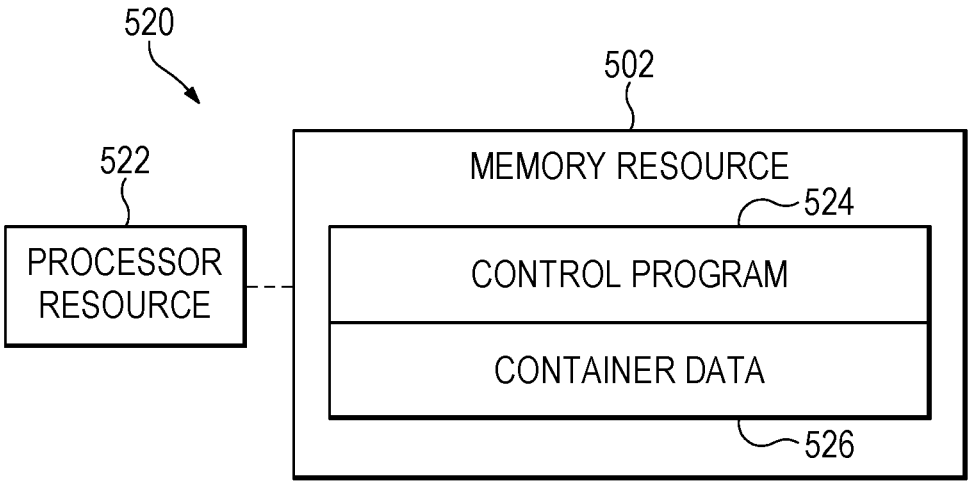
FIG. 5 is a block diagram depicting an example controller.

FIG. 5 is a block diagram depicting an example controller 520. The controller 520 may comprise a memory resource 502 operatively coupled to a processor resource 522. A memory resource may contain a set of instructions that are executable by the processor resource and the set of instructions (represented as control program 524 in FIG. 5) are operable to cause the processor resource to perform operations of the control program when the set of instructions are executed by the processor resource. For example, the processor resource 522 may execute the set of instructions corresponding to control program 524 to perform communication operations to retrieve data from a memory resource or pass data from the memory resource 502, such as container data 526, to another processor resource or storage location.

A processor resource is any appropriate circuitry capable of processing (e.g., computing) instructions, such as one or multiple processing elements capable of retrieving instructions from a memory resource and executing those instructions. For example, the processor resource may be a central processing unit (CPU) that enables container data retrieval by fetching, decoding, and executing modules of instructions. Example processor resources include at least one CPU, a semiconductor-based microprocessor, a programmable logic device such as an application specific integrated circuit (ASIC), and the like. A processor resource may include multiple processing elements that are integrated in a single device or distributed across devices. A processor resource may process the instructions serially, concurrently, or in partial concurrence.

A memory resource represents a medium to store data utilized and/or produced by a print material cartridge or print apparatus. The medium is any non-transitory medium or combination of non-transitory media able to electronically store data, such as the control program 524 and the container data 526. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be integrated in the same device as a processor resource or it may be separate but accessible to that device and the processor resource. A memory resource may be distributed across devices. A memory resource may be a non-volatile memory resource such as read-only memory (ROM), a volatile memory resource such as random-access memory (RAM), a storage device, or a combination thereof.

Figure 6:
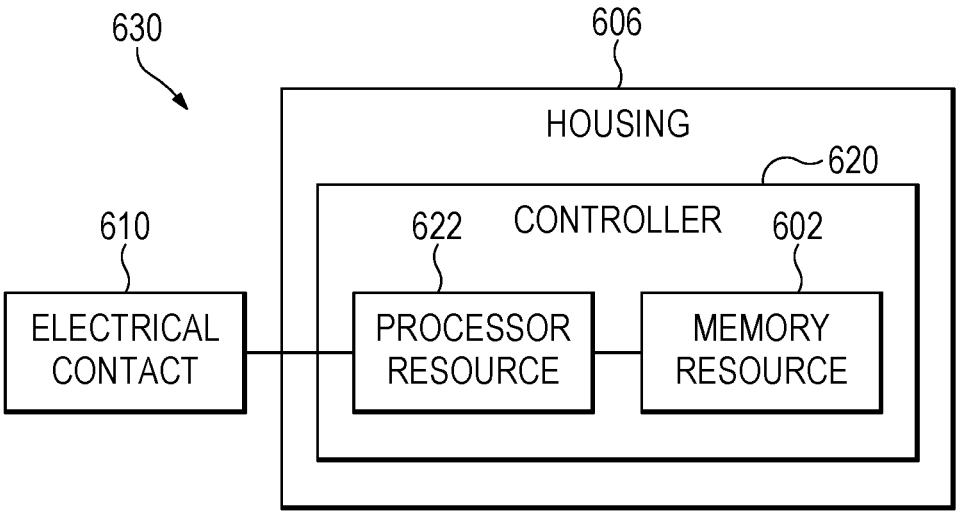
FIGS. 6 and 7 are block diagrams depicting example print material cartridges.
Figure 7:
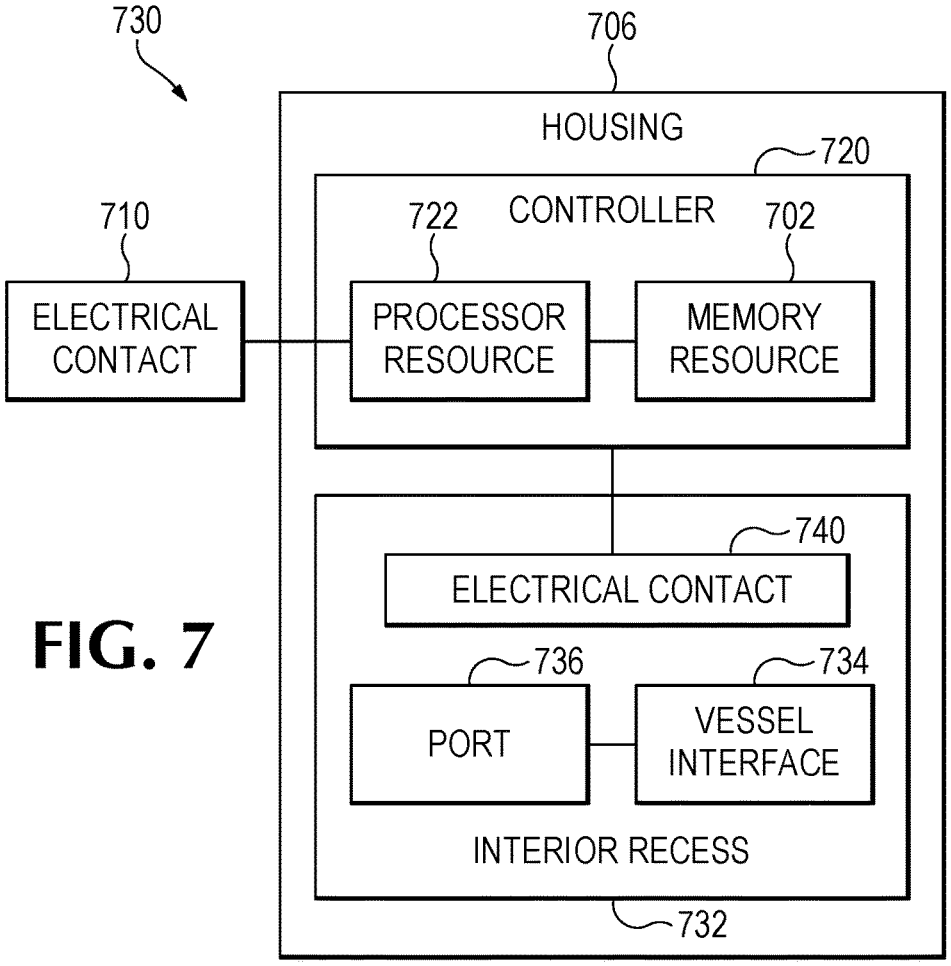

FIGS. 6 and 7 are block diagrams depicting example print material cartridges 630 and 730. Referring to FIG. 6, the print material cartridge 630 includes a housing 606, a controller 620 coupled to the housing 606, and an electrical contact 610 externally located on the housing and electrically coupled to the controller 620. The controller 620 includes a processor resource 622 and a memory resource 602 similar to the controller 520 of FIG. 5 and their descriptions are not repeated for brevity. An example print material cartridge may be a toner cartridge comprising a housing, a controller embedded within a material of the housing, and a first electrical contact on an exterior surface of the housing and electrically coupled to the controller.

Referring to FIG. 7, an example print material cartridge 730 may include a housing 706, a controller 720, and an electrical contact 710 similar to the housing 606, controller 620, and the electrical contact 610 of FIG. 6. The housing 730 of FIG. 7 may define a recess 732 to receive a print material container. The housing 730 may include a container interface 734 at the recess 732. The container interface 734 may be coupled to a port 736 defined by the housing 706. The container interface may be coupled to an electrical contact 740. A print material container may be sealingly coupled to the port 736 and electrically coupled to the electrical contact 740 via the vessel interface 734. In this manner, data and communications may be transferred via an electrical interface of the container interface (e.g., the electrical contact 740 coupled to the container interface 734) and print material may be transferred via the material transfer interface of the container interface (e.g., the port 736 coupled to the container interface 734). The electrical contact 740 may be located on a recess wall defining the interior recess and electrically coupled to the controller via an electrical lead extending from the recess wall to the location of the memory resource 702 embedded in the housing 706.

Figure 8:
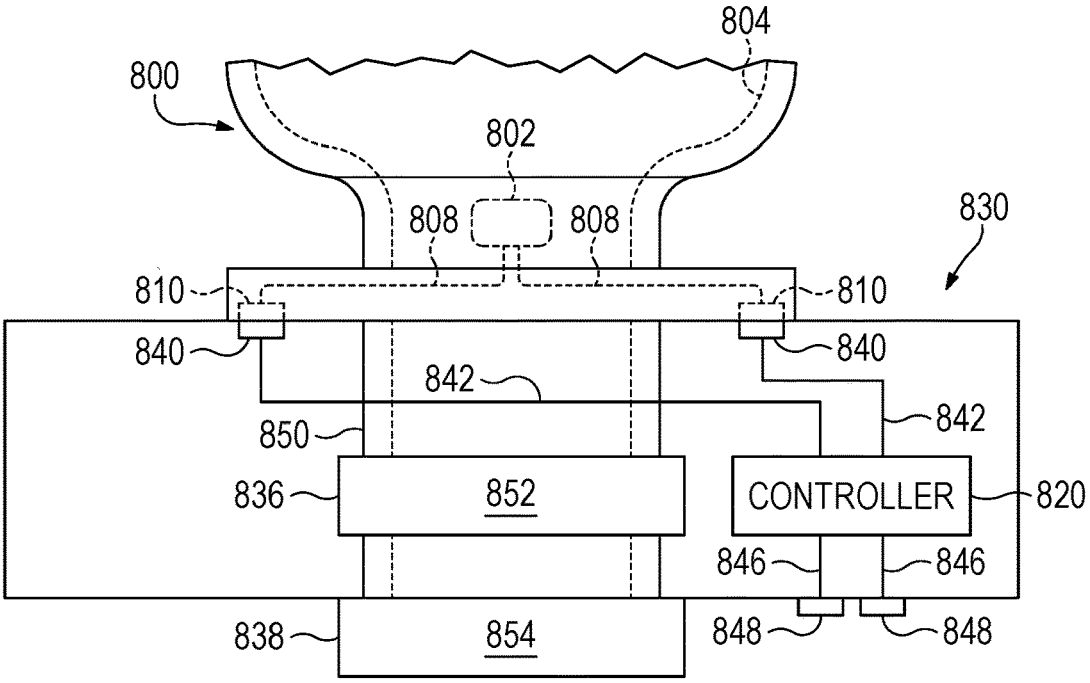
FIG. 8 is a sectional view of an example container coupled to an example cartridge.

FIG. 8 is a sectional view of an example container 800 coupled to an example cartridge 830. The print material of the container 800 is transferable from the print material chamber 804 to an input port 836 of the cartridge (e.g., via a channel of the neck of the container coupled to the chamber). The input port 836 is coupled to an output port 838 of the cartridge 830 to transfer the print material to a print apparatus (e.g., the port of a toner cartridge is sealingly coupleable to a toner receiving station of a print apparatus). For example, a rim of the container 800 may define a port 850 coupled to the print material chamber 804 that is sealingly coupleable to a port 836 of a cartridge 830, where the cartridge 830 may be able to dispense print material from the print material chamber 804 to output port 838 via the connection between the container port 850 and the input port 836 of the cartridge 830.

The print material container 800 is coupled to the print material cartridge 830 via a container interface. The container interface may include a print material transfer interface as described above and an electrical interface. In an example, the container 800 is a coupled to a shell of the cartridge with a recessed interface to receive a rim of the container 800. In that example, an electrical contact on the cartridge may be placed in a complementary location to the electrical contact of the container when the container is sealingly coupled to the recessed interface.

The print material container includes a memory resource 802 and an electrical contact 810 coupled to the memory resource 802 via an electrical lead 808. When the print material container is moved to the contact position, the electrical contact 810 aligns towards the electrical contact 840 of the print material cartridge 830. The electrical contact 840 of the cartridge is electrically coupled to the controller 820 via electrical lead 842. The controller 820 is electrically coupled, via electrical lead 846, to the electrical contact 848 on the exterior of the cartridge 830 at an electrical interface for a print apparatus. The controller 820 coupled to the cartridge shell may include a processor resource electrically coupled to the electrical contact 840 on of the cartridge shell so that the processor resource is able to retrieve data from the memory resource 802. The electrical leads 808 may be connected to a communication interface of the memory resource 802 and/or connected to a power interface of the memory resource 802. As used herein, a communication interface is any appropriate circuitry to enable preparation of signals and/or transmission of signals along an electrical path. A power interface, as used herein, may refer to any appropriate circuitry to enable transfer of electrical power along an electrical path, including a ground connection for example. In some examples, the controller 820 may communicate data and provide power to the memory resource 802 over the same electrical path, such as manipulating characteristics of the signal to encode data.

The controller 820 may include a set of instructions that when executed cause the controller to retrieve data from the memory resource 802 of the print material container 800 via a first group of electrical leads 842 between the controller 820 and the electrical contacts 840 and provide a signal, via a second group of electrical leads 846, to the electrical contacts 848 where the signal corresponds to the data retrieved from the memory resource 802 of the print material container. In this manner, the controller 820 may provide (e.g., relay or actively transmit) the signal to be received by a print apparatus via an electrical connection with the electrical contacts 848 when the print material cartridge 830 is electronically coupled to a print material receiving station of the print apparatus.

The cartridge shell may include a recess or other exterior surface that defines a guide feature to guide connection of the container to a receiving area such that the guide feature guides the electrical contact of the container towards an electrical contact of the receiving area. For example, the guide feature may be a recess that guides movement of electrical contacts of the container towards electrical contacts of the cartridge (located inside the recess) upon insertion of the container into the recess of the cartridge. For another example, the guide feature may be a protrusion with electrical contacts located thereon that align with electrical contacts on an exterior surface of the container when the mechanical port of the container mates with the protrusion of the cartridge shell upon directing the container towards the cartridge at the location of the protrusion.

Figure 9:
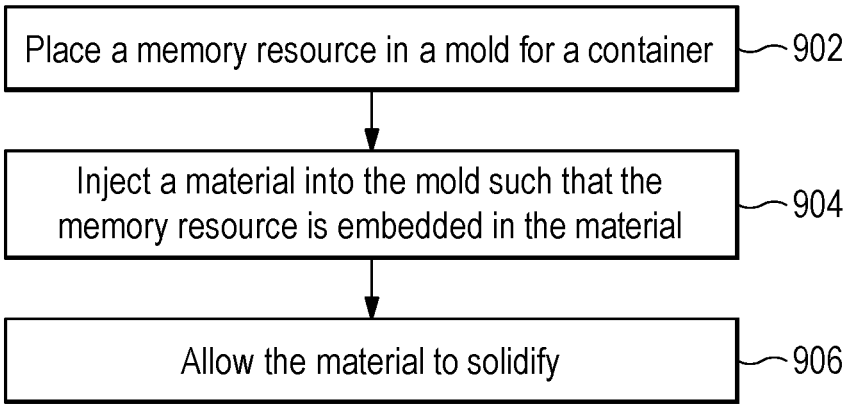
FIGS. 9 and 10 are flow diagrams depicting example methods of manufacturing an example container.
Figure 10:
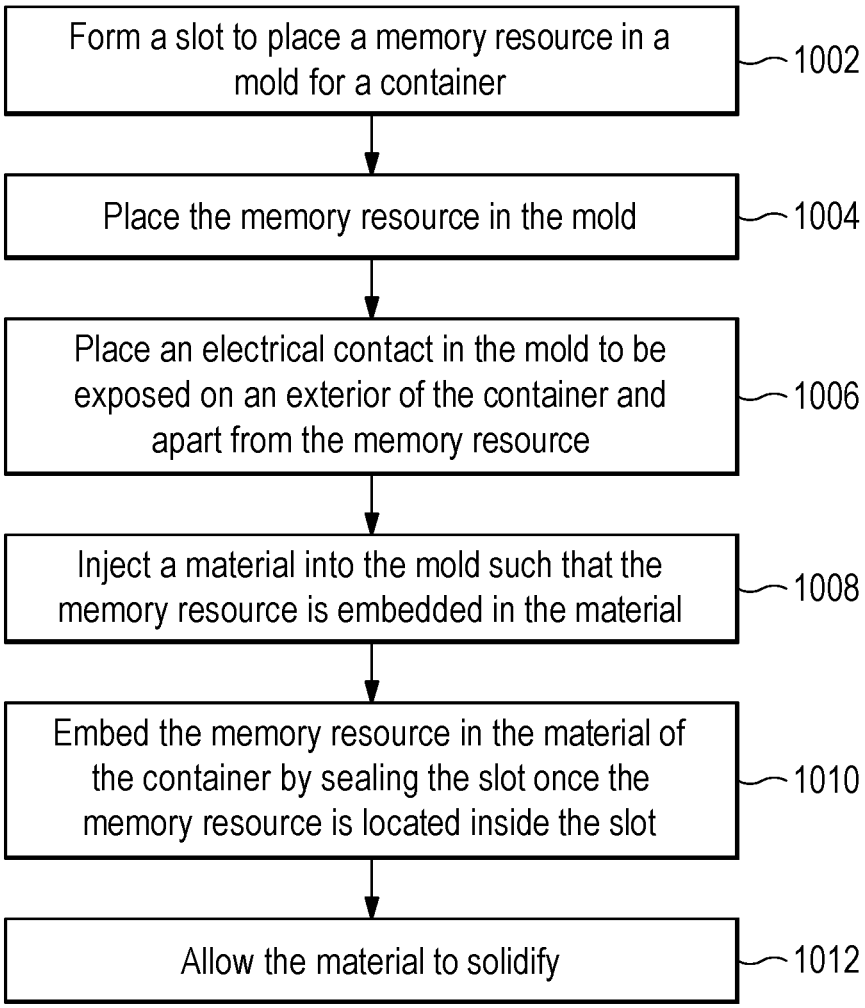

FIGS. 9 and 10 are flow diagrams depicting example methods of manufacturing an example container. Referring to FIG. 9, example methods of manufacturing a container may generally comprise placing a memory resource in a mold, injecting material into the mold, and allowing the material to solidify. A product with a memory resource embedded in a wall of the product may result from performing the methods of manufacturing discussed herein. For example, an example container of FIGS. 2-4 may result from performing the method of FIG. 9 and/or the method of FIG. 10.

At block 902 of FIG. 9, a memory resource is placed in a mold for a container. The mold may be shaped to provide a space for the memory resource to allow, for example, material to form around the memory resource. At block 904, a material is injected into the mold such that the memory resource is embedded in the material. The memory resource may be placed in a protective shell as to not become defective via the manufacturing process. In such an example, the material injected in the mold may form around the memory resource shell to surround the memory resource with a layer of the material to protect the memory resource from contact. At block 906, the material is allowed to solidify. In this manner, the layer of material around the memory resource is to become, for example, a protective layer of solid material from malleable or otherwise formable material. Allowing the material to solidify may utilize a particular time period or environmental condition to assist solidification of the material, such as heating or cooling the material over a particular time frame.

FIG. 10 includes blocks similar to blocks of FIG. 9 and provides additional blocks and details. In particular, FIG. 10 depicts additional blocks and details generally regarding forming a slot, sealing the slot, and placing an electrical contact. Blocks 1004, 1008, and 1012 are the same as blocks 902, 904, and 906 of FIG. 9 and, for brevity, their respective descriptions are not repeated.

At block 1002, a slot is formed in a mold as a location to place a memory resource. At block 1004, the memory resource is placed in the slot formed at block 1002. At block 1006, an electrical contact is placed in the mold in a location such that the electrical contact is to be exposed on an exterior of the container resulting from the mold. The electrical contact is placed a distance apart from the memory resource and the electrical contact is electrically coupled to the memory resource such as coupled via an electrical lead. At block 1008, material is injected into the mold such that the memory resource is embedded in the material. At block 1010, the slot is sealed after the memory resource is located inside the slot. The slot may be sealed by injecting material over an aperture in which the memory slot was placed, for example, and the sealing may occur at the same time as the operations at block 1008. In other examples, the memory resource may be sealed in a protective casing and then placed in the slot of the mold to be surrounded by material injected at block 1008. At block 1012, the material is allowed to solidify around the memory resource and the electrical lead to the electrical contact. The result of the method of FIG. 10 may include an electrical path exposed and coupleable via the electrical contact while the memory resource is protected within the solidified material of a wall of the container resulting from the method, for example.

Although the flow diagrams of FIGS. 9-10 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the use of the words "first," "second," or related terms in the claims are not used to limit the claim elements to an order or location, but are merely used to distinguish separate claim elements.

The present description has been shown and described with reference to the foregoing examples. It is understood, however, that other forms, details, and examples may be made without departing from the spirit and scope of the following claims.

What is claimed is:

1. A container comprising:

a housing defining:

a print material chamber; and a wall;

a memory resource embedded in the wall of the housing;

an electrical contact coupled to an exterior of the container; and an electrical lead coupling the memory resource to the electrical contact.

2. The container of claim 1, wherein:

the housing defines:

a body, the print material chamber located within the body;

a neck coupled to the body; and a rim coupled to the neck.

3. The container of claim 2, wherein the memory resource is embedded in:

the rim of the container, the neck of container, or the body of the container; and the rim defining a port coupled to the print material chamber.

4. The container of claim 2, wherein:

the electrical contact is located on an exterior surface of the rim, neck, or body.

5. The container of claim 4, wherein:

the exterior surface defines a guide feature of the rim to guide connection of the container to a receiving station, such that the guide feature guides the electrical contact of the container towards an electrical contact of the receiving station.

6. The container of claim 4, wherein:

the electrical lead is connected to a communication interface of the memory resource; or the electrical lead is connected to a power interface of the memory resource.

7. The container of claim 2, wherein:

the container is coupled to a cartridge shell, the cartridge shell comprising:

a recessed interface to receive the rim of the container;

an electrical contact in a complementary location to the electrical contact of the container when the container is sealingly coupled to the recessed interface.

8. The container of claim 2, wherein:

the cartridge shell includes a processor resource electrically coupled to the electrical contact of the cartridge shell, the processor resource to retrieve data from the memory resource.

9. A toner cartridge comprising:

a housing;

a controller embedded within a material of the housing; and a first electrical contact on an exterior surface of the housing and electrically coupled to the controller.

10. The toner cartridge of claim 9, wherein the housing defines:

a recess with a container interface; and a port coupled to the container interface.

11. The toner cartridge of claim 10, comprising:

a second electrical contact on a recess wall defining the recess and electrically coupled to the controller.

12. The toner cartridge of claim 11, comprising:

a toner container coupled to the toner cartridge via the container interface, the toner container including a memory resource and a third electrical contact, wherein:

the port is coupleable to a toner receiving station of a print apparatus;

the third electrical contact is in contact with the second electrical contact when the toner container is sealingly coupled to the toner cartridge; and the controller includes a set of instructions that when executed cause the controller to:

retrieve data from the memory resource of the toner container via a first group of electrical leads between the controller and the second electrical contact; and provide a signal to the first electrical contact corresponding to the data retrieved from the memory resource of the toner container, the print apparatus to receive the signal via an electrical connection with the first electrical contact when the toner cartridge is coupled to the toner receiving station of the print apparatus.

13. A method of manufacturing a container, comprising:

placing a memory resource in a mold for the container;

injecting a material into the mold such that the memory resource is embedded in the material; and allowing the material to solidify.

14. The method of claim 13, comprising:

placing an electrical contact in the mold to be exposed on an exterior of the container and apart from the memory resource, the electrical contact electrically coupled to the memory resource;

forming a slot to place the memory resource in the mold; and embedding the memory resource in the material of the container by sealing the slot once the memory resource is located inside the slot.

15. A product resulting from the method of claim 13.

* * * * *